US005492494A

United States Patent [19]

Keennon

[11] Patent Number: 5,492,494

[45] Date of Patent: Feb. 20, 1996

[54] TOY AIRCRAFT WITH VERTICAL FLIGHT DYNAMICS

[76] Inventor: Matthew Keennon, 4002 Via Lucero, #6, Santa Barbara, Calif. 93110

[21] Appl. No.: 355,048

[22] Filed: Dec. 13, 1994

[51] Int. Cl.[6] ..... A63H 27/127

[52] U.S. Cl. ..... 446/44; 446/37

[58] Field of Search ..... 446/44, 37, 36, 446/60, 59, 57

[56] References Cited

U.S. PATENT DOCUMENTS

| | | | |
|---|---|---|---|
| 2,138,168 | 11/1938 | Horak | 446/44 |
| 2,418,269 | 4/1947 | Lewis | 446/44 |
| 2,845,746 | 8/1958 | McKinney | 446/44 |
| 3,222,816 | 12/1965 | Effinger, Jr. et al. | 446/60 |

FOREIGN PATENT DOCUMENTS

| | | | |
|---|---|---|---|
| 617386 | 9/1949 | United Kingdom | 446/44 |

*Primary Examiner*—Mickey Yu
*Attorney, Agent, or Firm*—Elliott N. Kramsky

[57] ABSTRACT

A hobby aircraft arranged for vertical flight aerodynamics. A substantially-planar body is symmetrical about a central axis. An upper blade is fixed to the bottom of the body. An elastic band is aligned with the central axis for powering a lower blade that is in spaced relation to the upper blade. Rotation of the second blade is controlled by means of a locking mechanism to assure that gravity alone powers the final stage of aircraft flight.

11 Claims, 3 Drawing Sheets

TOY AIRCRAFT WITH VERTICAL FLIGHT DYNAMICS

BACKGROUND

1. Field of the Invention

The present invention relates to hobby or toy aircraft. More particularly, this invention pertains to such an aircraft incorporating aerodynamic design features for facilitating a substantially-vertical flight path.

2. Description of the Prior Art

Toy or hobby aircraft provide fun and recreation for enthusiasts of all ages. They can range in complexity from hand-launched gliders of paper or balsa wood construction to radio-controlled, gasoline engine-powered replicas of many sizes.

Each class of hobby aircraft possesses a particular appeal. The simpler and more economical varieties are generally suitable for youngsters and others seeking an enjoyable diversion without substantial financial or time commitment. The more technologically sophisticated and complex models, in contrast, can become a modeller's lifetime passion. Interestingly, an early interest in such "serious" modeling may indicate or develop into the choice of a subsequent career path (e.g. pilot or aerospace engineer).

While the "extremes" of this recreation are associated with hobby aircraft of corresponding performance levels, a large market exists for "in-between" aircraft that possess interesting, and perhaps fascinating, aerodynamic performance without demanding a substantial investment of time or money.

SUMMARY OF THE INVENTION

The present invention addresses the foregoing and other shortcomings of the prior art by providing a powered aircraft of relatively-simple and economical construction and design that offers interesting aerodynamic performance. Such aircraft includes a body that is symmetrical about a central axis. A first blade is fixed to an end of the body and is substantially orthogonal to the central axis. A second blade is also provided.

Means are provided for mounting the second blade along the central axis in spaced relationship to the first blade and rotatable with respect thereto. An elastic band for storing torsional energy is aligned with the central axis. Means are provided for is. Means are provided for selectively restraining the second blade. Means engaged to said second blade are further provided for stabilizing the body so that the central axis is in a substantially vertical plane.

The preceding and other features and advantages of this invention will become further apparent from the detailed description that follows. Such description is accompanied by a set of drawing figures. Numerals of the drawing figures, corresponding to those of the written description, point to the various features of the invention. Like numerals refer to like features throughout both the drawing figures and the written text.

DETAILED DESCRIPTION OF THE PREFERRED EMBODIMENT

Figure 1A:
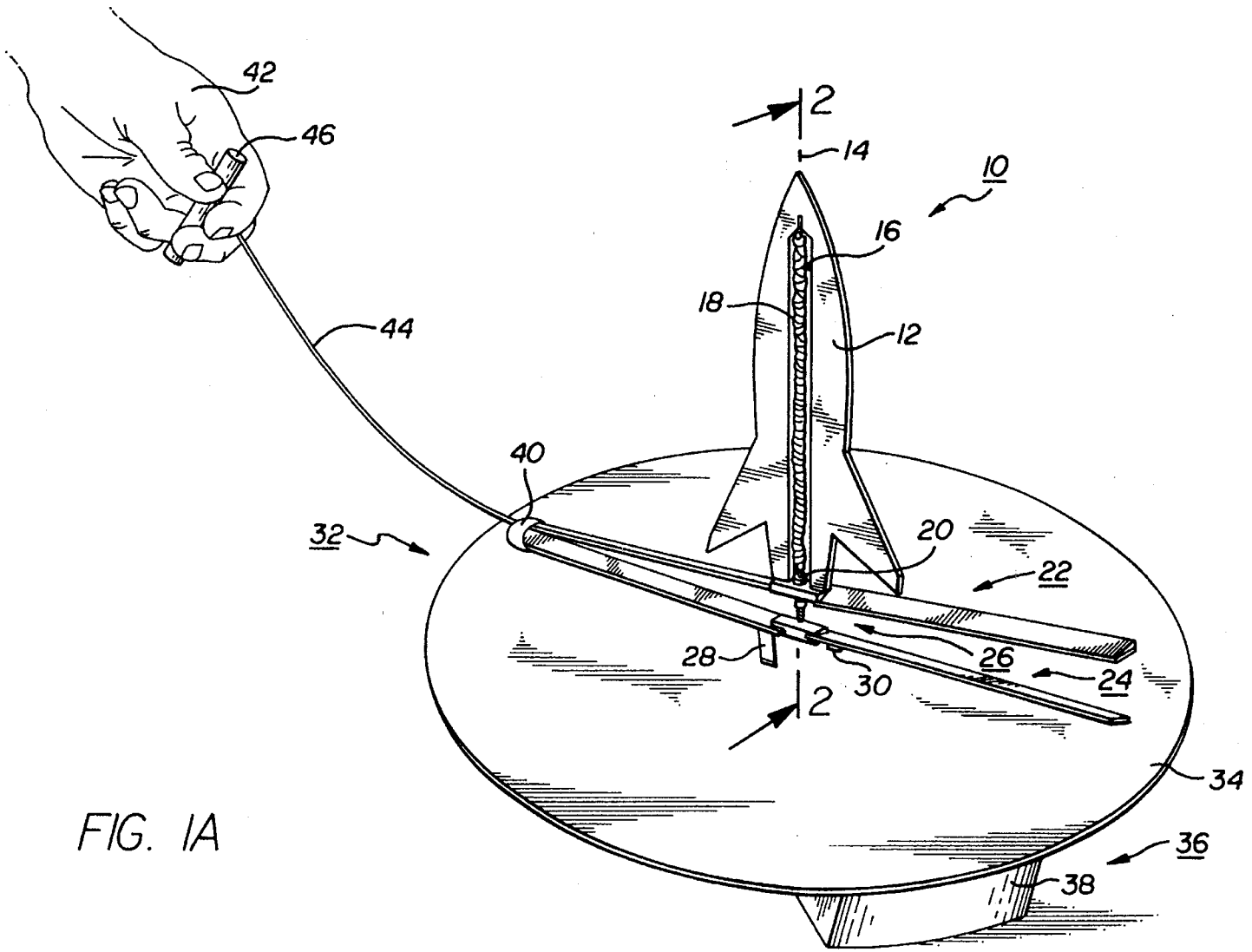
FIGS. 1A and 1B are perspective views of the toy aircraft of the invention with elements thereof deployed in their pre-launch and flight attitudes respectively.

Turning now to the drawings, FIG. 1A is a perspective view of the toy aircraft 10 of the invention with the various functional elements thereof deployed in pre-launch configuration. The aircraft 10 may include a body 12 comprising a substantially-planar cutout of balsa wood or like lightweight material. The body 12 needn't be planar, only symmetrical. It may be shaped to resemble an airplane, a rocket or, for that matter, any other device, arbitrary or otherwise, that is symmetrical about the central axis 14.

The body 12 includes an elongated internal appature 16 to receive an elastic band 18 that is aligned with the central axis 14. The band 18 extends from the top to the bottom of the elongated internal aperture 16, streched therebetween and fixed to the top of an elongated threaded member 20. As will be discussed in greater detail below, the elongated threaded member 20 interacts with related mechanisms that set or lock the angular attitude of a second or lower blade 24 relative to a first or upper blade 22 upon terminaton of blade 24 rotation.

The first or upper blade 22 is fixed to the bottom of the body 12 and is symmetrical with respect to the central axis 14. Similarly, the lower or second blade 24, spaced therefrom by means of a rod assembly 26 that coincides with the central axis 14, is also symmetrical about the central axis 14.

Support struts 28 and 30 are fixed to the bottom of the second or lower blade 24 for stabilizing the body 12 in a vertical or upright position as shown in FIG. 1. A launch platform 32 may be provided comprising a planar disk 34 seated upon a base 36 comprising at least one, and preferably three (3), equiangularly-spaced, radially-directed stabilizers such as the footing 38.

As mentioned earlier, the aircraft 10 is illustrated in FIG. 1 in its pre-launch mode, poised for verical flight. The aircraft is so prepared by winding the elastic band 18. This may be accomplished by holding the body 12 (including the first or upper blade 22 fixed thereto) with one hand and rotating the second or lower blade 24, twisting and knoting the elastic band 18 to store potential torsional energy therein. A ring 40 of rubber or like, preferably flexible, material may be slipped over the tips of the first and second blades 22 and 24 by a user 42. The ring 40 is fixed to one end of a cord 44. The oppossed end of the cord 44 may terminate with a handle 46 for facilitating the user's grasp.

In operation, the aircraft 10 is launched by directing an axial disengagement force through the cord 44 to free the ends of the blades 22 and 24. This permits the lower blade 24, coupled to the energy stored in the elastic band 18 through the rod assembly 26, to spin relative to the body 12 (and the upper blade 22 that is fixed thereto). In sum, the blade 22 and 24 effectively counterrotate relative to one another, powering the aircraft 10 vertically.

Figure 1B:
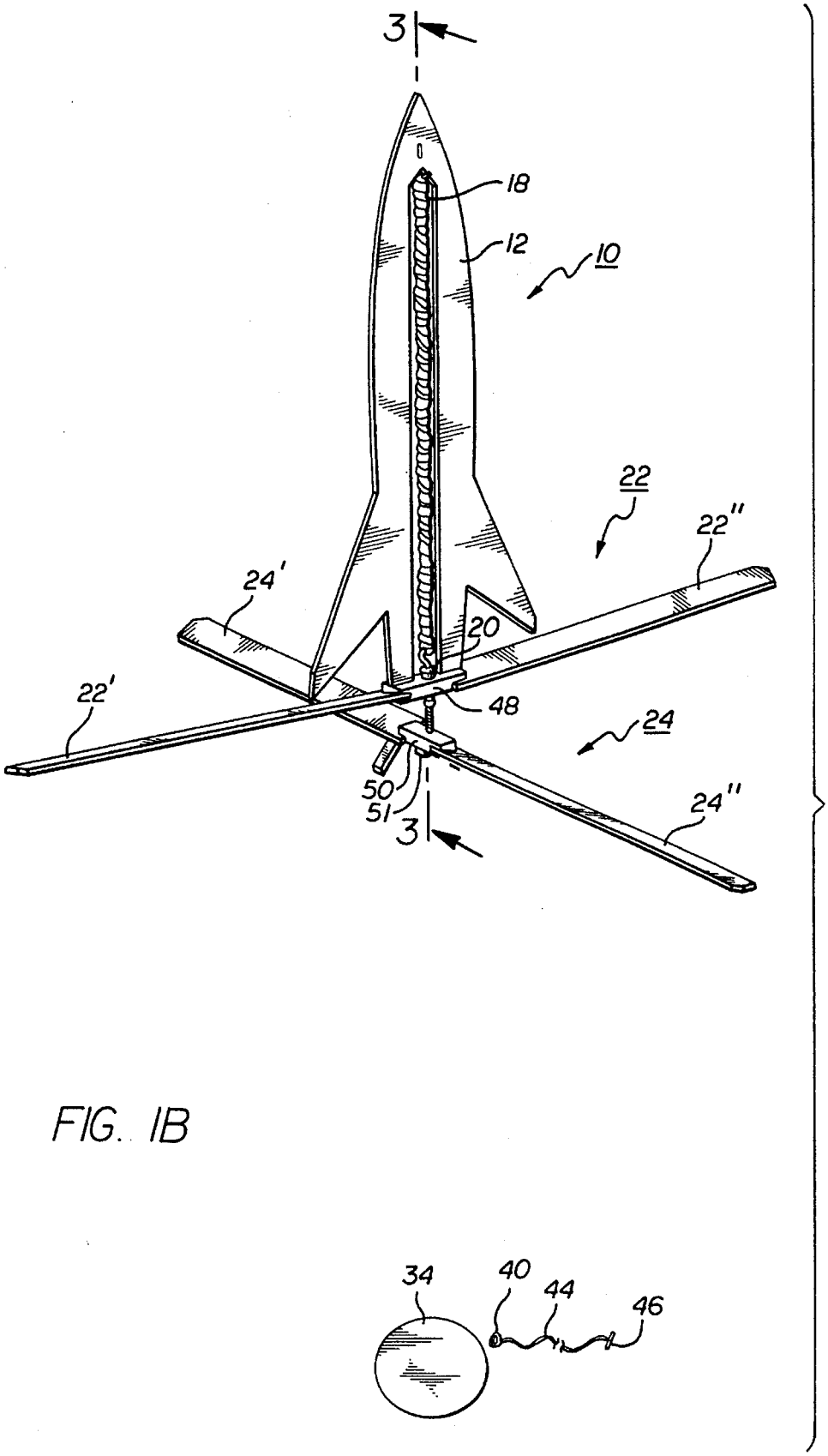

FIG. 1B is a perspective view of the toy aircraft of the invention during vertical flight. More specifically, the aircraft 10 is illustrated subsequent to having reached maximum verical height. In accordance with aerodynamic principples, a brief period of hovering or motionless flight occurs at the apex. This is followed by a near-vertical descent as the potential energy stored in the wound elastic band 18 is played out and converted to lesser levels of kinetic energy. As shown in FIG. 1B, as the gradual unwinding of the elastic band 18 proceeds, the elongated threaded member 20 becomes "seated" within the upper blade 22. This acts to lock or prevent further rotation of the lower blade 24 so that the angular orientation of the blade 22 becomes fixed relative to that of the blade 24. The mechanism for locking the blade 24 is preferably adjusted so that the two blades 22 and 24 are fixed substantially orthogonal to one another as shown. While the capability of fixing the relative angle upon termination of rotation over an unlimited range constitutes a feature of the present invention, a right angle is generally preferable as this maximizes the likelihood that the aircraft 10 will remain vertical upon landing.

It can be seen in FIG. 1B that each of the blades 22 and 24 comprises a pair of oppositely-pitched blade members. Upper blade members 22' and 22" are oppositely-pitched as are lower blade members 24' and 24". Each blade is completed by fixing its oppositely-pitched blade elements to a central blade block. An upper blade block 48 receives the oppositely-pitched upper blade members 22' and 22" while a lower block 50 receives and fixes the oppositely-pitched lower blade members 24' and 24". A small cushioning block 51 of sponge rubber or like material is fixed to the bottom of the lower block 50. The cushioning block provides shock protection for the mechanisms aligned with the central axis 14 when the aircraft 10 descends upon a hard surface such as concrete.

Figure 2:
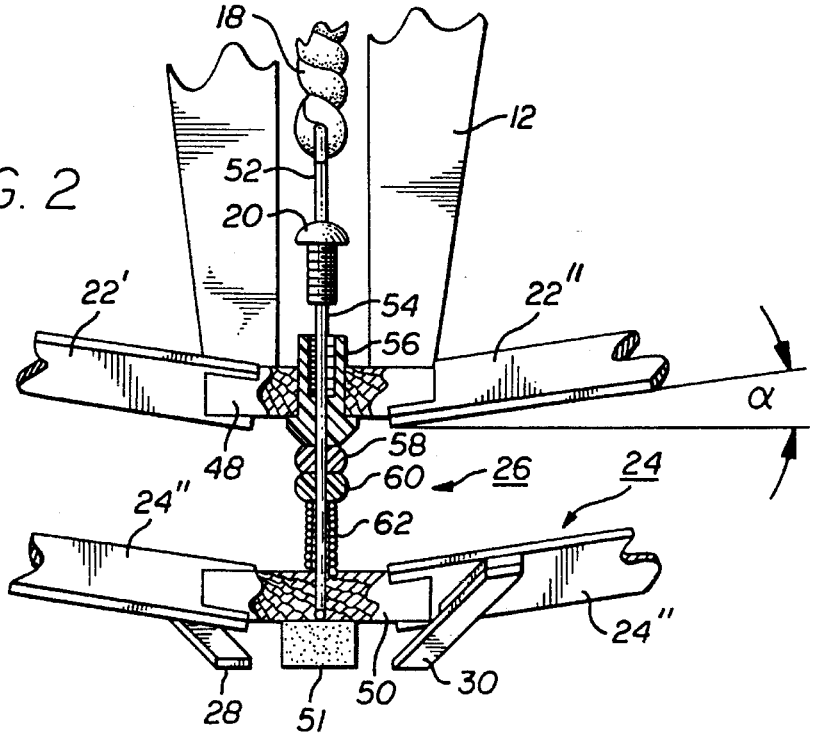
FIG. 2 is a detailed partial view taken along view line 2—2 of FIG. 1A and illustrating the pre-launch attitudes of components of the blade rotation locking subsystem.

As mentioned, the aircraft 10 of FIG. 1B is in a vertical descent path with rotation of the lower blade 24 terminated or locked by means of mechanisms referred to above. FIG. 2 is a partial detailed view of the lower portion of the aircraft 10 taken at view line 2— 2 of FIG. 1A. This view illustrates the disposition of the elements of the blade-locking mechanism just prior to removal of the rotation restraining ring 40. The elastic band 18 is wound tight in the pre-launch configuration of FIG. 1A. The bottom of the band 18 is coupled to the elongated threaded member 20 by a hook 52 fixed to the top thereof. A rod 54 is fixed to the bottom of the elongated threaded member 20. The rod 54 extends through a cup 56 that is press-fit within the upper blade block 48 which, as mentioned previously, is joined to the bottom of the body 12. The cup 56 is interiorly threaded to receive the elongated threaded member 20.

The rod 54 is rotatable with respect to the cup 56 and extends therethrough. Aligned bearings 58 and 60 are positioned above the lower end of the cup 56. A compression spring 62 is seated coaxially with the rod 54 and positioned between the bottom of the bearing 60 and the top of the lower blade block 50. The lower end of the rod 54 is received within and fixed to the lower blade block 50 as shown.

In operation, once the ring 40 is freed and rotation of the lower blade 24 no longer restrained, potential energy stored in the elastic band 18 is converted to kinetic rotational energy causing the elongated threaded member 20 to rotate therewith. As the potential energy stored within the elastic band 18 gradually dissipates, the axial (upwardly directed) force exerted by the formerly-taut band 18 lessens, allowing the axial compression force stored in the partially-compressed spring 62 to cause the spring 62 to expand axially, lengthening the distance between the upper blade 22 and the rotating lower blade 24. As this distance increases through the redistribution of relative axial forces between the band 18 and the spring 62 the elongated threaded member 20 is pulled in a downward direction.

Figure 3:
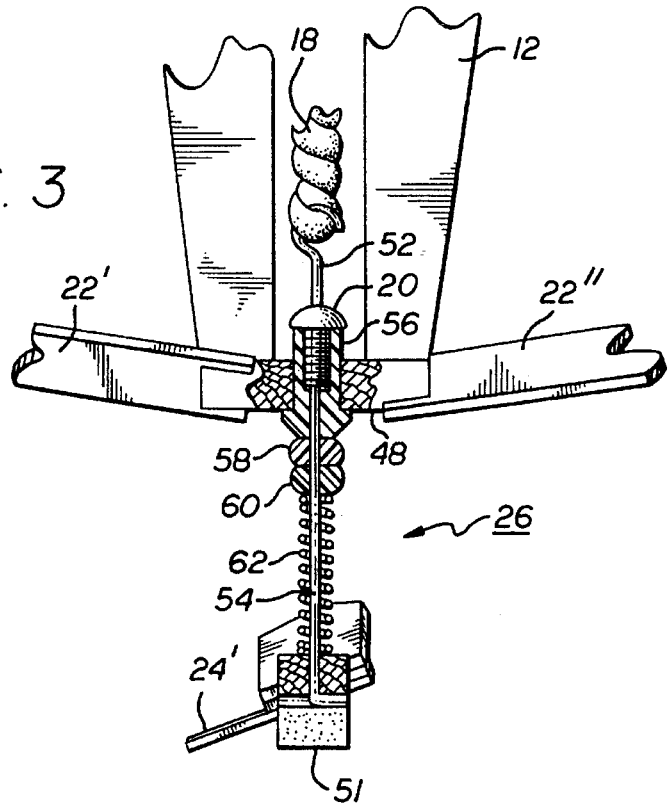
FIG. 3 is a detailed partial view of the toy aircraft taken at view line 3—3 of FIG. 1B illustrating the flight attitudes of the components of the blade rotation locking subsystem (blade rotation terminated).

FIG. 3 is a partial detailed view of the mechanisms described with reference to the preceeding figure taken at view line 3—3 of FIG. 1B (post-locking configuration). Continuing the discussion from above, as the elongated threaded member 20 continues to be pulled relative to the cup 56 fixed to the upper blade block 50, the threads of the elongated threaded member 20 at some point engage the inwardly-threaded cup 56. After this occurs, continuing rotation of the elongated threaded member 20 will be translated into further downward movement thereof until, as shown in FIG. 3, it becomes "seated" within the cup 56. The mated threadings of the elements assure that once the elongated threaded member 20 has traveled sufficiently it will cease rotation, preventing further translation of potential energy still stored within the elastic band 18 into rotation of the rod 54. Further rotation of the rod 54, and of the attatched lower blade 24, cannot occur and the angular positions of the blades 22 and 24 relative to one another will remain locked thereafter. As mentioned earlier, it is generally advantageous to lock the blades 22 and 24 into orthogonal orientations so that the aircraft 10 will remain upright and vertical upon landing.

The mechanisms described in FIGS. 2 and 3 permit the user to adjust the locking angular position of the lower blade 24 relative to the upper blade 22. This is easily accomplished through rotation of the cup 56 within the upper blade block 48 about the central axis 14 when the elongated threaded member 20 is fully seated. This adjustment is readily accomplished as the cup 56 is press-fit within the upper block 48.

In addition to assuming a desirable final relative angular orientation between the blades 22 and 24, the rotation locking mechanism provides other advantages. Full dissipation of the energy stored within the band 18 would risk a landing with the lower blade 24 still spinning and possibly damage the aircraft 10. The aerodynamics of a powered aircraft become less stable as flight becomes under-powered. In the present aircraft 10, power is cut off before it can adversely affect flight aerodynamics. Furthermore, by locking the blades 22 and 24 into mutually orthogonal positions, the aerodynamic drag upon the descending craft is evened out, permitting it to fall without tumbling. Design factors, such as symmetry of the body 12 and the low center of gravity of the aircraft 10, allow gravity forces to take over to provide a controlled, substantially vertical, final flight phase.

As further shown in FIGS. 2 and 3, the blade members 22' and 22" are each canted at small dihedral angles $\alpha$ from horizontal. The lower blade elements 24' and 24" may also be so canted. The inclinations of the blade members serve to stabilize vertical flight. As the aircraft 10 begins to tilt (i.e. the central axis 14 deviating from vertical) the blade member toward which the axis 14 has tilted will become closer to horizontal, enhancing its lift force. At the same time, the other blade member (from which the central axis tilts) will make a correspondingly greater angle to the horizontal, reducing its lift force. The net result of the two above-described actions will be to return the central axis 14 toward vertical as the blade toward which it has tilted will be exerting a stronger upward (return) force while the blade member at the opposite side will exert a smaller lift force.

Thus it is seen that the present invention provides a toy aircraft that posseses numerous useful aerodynamic features and qualities. The simple construction of the aircraft of the invention provides economical and pleasurable amusement for the casual hobbyist.

While this invention has been displayed with reference to its presently preferred embodiment, it is not limited thereto. Rather, this invention is limited only insofar as it is described in the following set of patent claims and includes within its scope all equivalents thereof.

What is claimed is:

1. An aircraft comprising, in combination:

a) a body, said body being symmetrical about a central axis that extends between a top and a bottom, b) a first blade symmetrical with respect to said central axis comprising a pair of planar first blade members of opposite pitch inclined upwardly from horizontal at a predetermined dihedral angle, said first blade being fixed adjacent the bottom of said body and substantially orthogonal to said central axis;

c) a second blade symmetrical with respect to said central axis comprising a pair of second blade members of opposite pitch;

d) means for mounting said second blade so that said second blade is spaced from said first blade along said central axis and rotatable with respect thereto;

e) an elastic band aligned with said central axis for storing torsional energy;

f) means for selectively restraining rotation of said second blade; and g) means fixed to said second blade for stabilizing said body so that said central axis is oriented in a substantially vertical plane when said aircraft is on the ground.

2. An aircraft as defined in claim 1 further including means for locking rotation termination of said second blade with respect to said first blade at a predetermined angle.

3. An aircraft as defined in claim 2 wherein said means for locking is engaged to an end of said elastic band.

4. An aircraft as defined in claim 3 wherein said means for locking additionally includes:

a) an elongated rod, said rod being aligned with said central axis;

b) one end of said rod being rotatably coupled to said first blade;

c) the opposed end of said rod being fixed to said second blade;

d) means for terminating rotation of said rod; and e) said last-named means is responsive to rotation of said band.

5. An aircraft as defined in claim 4 wherein said means for terminating rotation further includes:

a) an elongated threaded member;

b) one end of said elongated threaded member being fixed to said band and the opposed end of said member being fixed to said rod; and c) an interiorly-threaded cup member being fixed to the bottom of said body and arranged to receive said elonged member.

6. An aircraft as defined in claim 5 further including a spring member, said spring member being coaxial with said rod and positioned between the bottom of said body and said second blade.

7. An aircraft as defined in claim 1 further comprising:

a) an upper block, fixed to the bottom of said body, centrally engages each of said oppositely-pitched first blade members; and b) a lower block centrally engages each of said oppositely-pitched second blade members.

8. An aircraft as defined in claim 7 wherein said means for stabilizing further includes a support strut fixed to each of said second blade members.

9. An aircraft as defined in claim 1 further including a launch platform comprising a planar disk and a base for supporting said planar disk.

10. An aircraft as defined in claim 9 wherein said base includes a plurality of radially-directed footings.

11. Apparatus as defined in claim 1 further including:

a) a launcher;

b) said launcher including a ring for coupling said first blade to said second blade; and c) a cord fixed to said ring for applying an axial force to remove said ring from said blade.

* * * * *